US005611158A

United States Patent [19]

Pratt et al.

[11] Patent Number: 5,611,158

[45] Date of Patent: Mar. 18, 1997

[54] ASSEMBLY FOR COUPLING AN IMPLEMENT TO AN OPERATING ARM OF A MACHINE IN VARIOUS ANGULAR POSITIONS

[75] Inventors: Samuel S. Pratt, Bedford; Dan Shaffer, Duncansville; Tim A. Davis, Berlin; Ashley Heiple, Alum Bank, all of Pa.; Peter N. Lalos, Gaithersburg, Md.

[73] Assignee: Rockland, Inc., Bedford, Pa.

[21] Appl. No.: 443,151

[22] Filed: May 17, 1995

[51] Int. Cl.[6] ..... E02F 3/96

[52] U.S. Cl. ..... 37/468; 37/444; 172/272; 414/722; 414/723; 403/322

[58] Field of Search ..... 37/468, 444; 172/272, 172/273, 274; 414/722, 723, 724; 403/322, 103, 24, 359

[56] References Cited

U.S. PATENT DOCUMENTS

| | | | |
|---|---|---|---|
| 2,608,894 | 9/1952 | Miller, Jr. et al. | 403/103 X |
| 3,243,905 | 4/1966 | Ulrich | 414/740 X |
| 3,926,532 | 12/1975 | Schlenker et al. | 403/322 |
| 4,663,866 | 5/1987 | Karlsson et al. | 37/468 X |
| 4,938,651 | 7/1990 | Gilmor et al. | 414/723 X |
| 4,943,188 | 7/1990 | Peppel | 403/322 X |
| 4,944,628 | 7/1990 | Huldén | 37/468 X |
| 5,318,375 | 6/1994 | Entrup et al. | 403/322 X |
| 5,333,400 | 8/1994 | Sonerud | 37/468 |
| 5,467,542 | 11/1995 | Hulden | 37/468 |

*Primary Examiner*—Randolph A. Reese
*Assistant Examiner*—Thomas Beach
*Attorney, Agent, or Firm*—Lalos & Keegan

[57] ABSTRACT

An assembly for coupling an implement to an operating arm of a machine generally consisting of a first coupling component fixedly mountable on the implement, having a plurality of sets of opposed abutment surfaces spaced circumferentially relative to a given axis thereof and disposed substantially radially relative to such axis, and an axially spaced abutment surface, and a second coupling component disposable in mating relation with the first coupling component, having apparatus for detachably connecting to the operating arm, at least one locking member displaceable between an extended position and an retracted position received between a selected set of the radially disposed, opposed abutment surfaces and the axially spaced abutment surface, when the components are disposed in mating relation, and apparatus for selectively displacing the locking member into the extended and retracted positions.

15 Claims, 2 Drawing Sheets

ASSEMBLY FOR COUPLING AN IMPLEMENT TO AN OPERATING ARM OF A MACHINE IN VARIOUS ANGULAR POSITIONS

This invention relates to an assembly for coupling an implement to an operating arm of an excavator machine and the like and more particularly to such an assembly provided with a improved means for a selectively angularly displacing such an implement relative to the operating arm of the machine about a given axis.

In the prior art, there has been developed a type of assembly for coupling an implement to the operating arm of a machine generally consisting of a first coupling component fixedly secured to the working implement and a second coupling component mountable on the operating arm of a machine and cooperable with the first coupling component to detachably secure the working implement to the operating arm. The first coupling component generally includes an annular, undercut portion providing a beveled gripping surface, and the second coupling component includes a pair of gripping members displaceable relative to each other, having arcuate, beveled gripping surfaces engageable with the beveled gripping surface of the first coupling component to firmly attach the working implement to the operating arm. Such type of coupling assembly is illustrated and more specifically described in U.S. Pat. No. 4,944,628 dated Jul. 31, 1990.

In the type of coupling assembly as described, there typically is provided one or more hydraulic cylinder assemblies on the component connected to the operating arm for extending and retracting the gripping members of such component into and out of gripping relation with the coupling component fixably secured to the implement. The forces applied by such cylinder assemblies are required to be sufficient not only for firmly gripping the coupling component of the implement but also for resisting the torsional forces applied to the implement during normal use of the implement which otherwise would result in angular displacement of the implement relative to the operating arm of the machine about the aforementioned given axis. This requirement further has resulted in the use of larger cylinders in the coupler assemblies, adversely affecting the dynamics of the machine. It thus has been found to be desirable to provide a coupler assembly of the type described in which one or more smaller hydraulic cylinder assemblies may be used for gripping the implement thus reducing the mass of the coupler assembly and correspondingly improving the dynamics of the machine.

Accordingly, it is the principal object of the present invention to provide an improved assembly for coupling a working implement to the operating arm of an excavator machine and the like.

Another object of the present invention is to provide an improved assembly for coupling a working implement to the operating arm of an excavator machine and the like in which the implement may be angularly displaced relative to the operating arm about a given axis.

A further object of the present invention is to provide an improved assembly for coupling a working implement to the operating arm of an excavator machine and the like, utilizing a pair of members for gripping the implement in selected positions angularly displaced relative to the operating arm about a given angle.

A still further object of the present invention is to provide an assembly for coupling a working implement in selected positions angularly displaced relative to the operating arm of an excavating machine and the like, about a given axis, in which torsional forces applied to the implement during normal operational use are effectively resisted.

Another object of the present invention is to provide an improved assembly for coupling a working implement to the operating arm of an excavator machine and the like at selected positions about a given axis, utilizing a pair of gripping members actuated by hydraulic cylinder assemblies, in which comparatively smaller cylinder assemblies may be utilized thereby minimizing the mass of the assembly and correspondingly enhancing the dynamics of the machine.

A further object of the present invention is to provide an improved assembly for coupling a working implement to the operating arm of an excavator machine and the like in selected positions relative to a given axis, which is simple in design, utilizes comparatively new components, is effective in resisting torsional loads applied to the implement during normal use and provides a relatively low mass thereby enhancing the dynamics of the operating arm of the machine. Other objects and advantages of the invention will become more apparent to those persons having ordinary skill in the art to which the present invention pertains from the following description taken in conjunction with the accompanying drawings in which:

Figure 1:
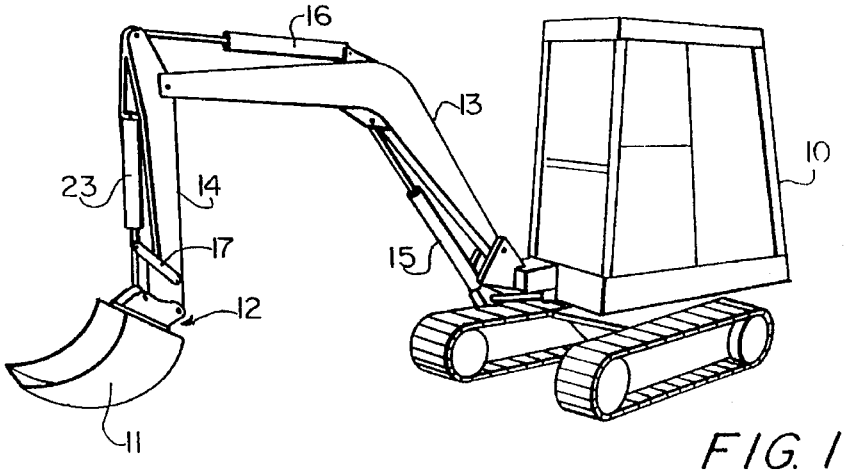
FIG. 1 is a perspective view of an excavating machine provided with a coupler assembly embodying the present invention.

Referring to FIG. 1 of the drawing, there is shown an excavator machine 10, a bucket 11 and an assembly 12 for detachably coupling the bucket to the excavating machine. The machine is provided with a conventional boom 13, an operating arm 14 pivotally connected to the free end of the boom, a hydraulic cylinder assembly 15 operatively interconnecting the frame of the machine and an intermediate portion of the boom for pivoting the boom and a hydraulically actuated cylinder assembly 16 operatively interconnecting a mid-portion of the boom and an upper end of the operating arm. The lower end of operating arm is provided with a pair of links 17 and 18 pivotally connected to the operating arm by means of a connecting pin 19, and a link 20 pivotally connected at one end to the free ends of links 17 and 18 by means of pin 21 and pivotally connected at the opposite end to the coupler assembly by means of a connecting pin 22. The bucket is caused to be pivoted relative to the operating arm by means of a hydraulically actuated cylinder assembly 23 operatively interconnecting an upper end of the operating arm and connecting pin 21. By operating cylinder assemblies 15, 16 and 23 by the use of controls provided at an operator's station in the cab of the machine, bucket 11 or any other working implement such as a grapple, rake, stump splitter, rock crusher, jack hammer and the like may be maneuvered to perform various work functions including excavating, grappling, grading, raking, clearing, splitting, crushing, breaking and the like, in the conventional manner.

Figure 4:
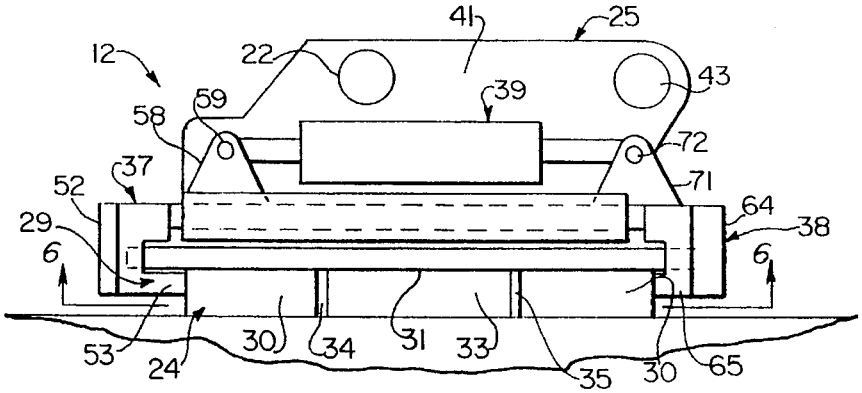
FIG. 4 is an enlarged, side elevational view of the coupler assembly shown in FIGS. 1 and 3.
Figure 5:
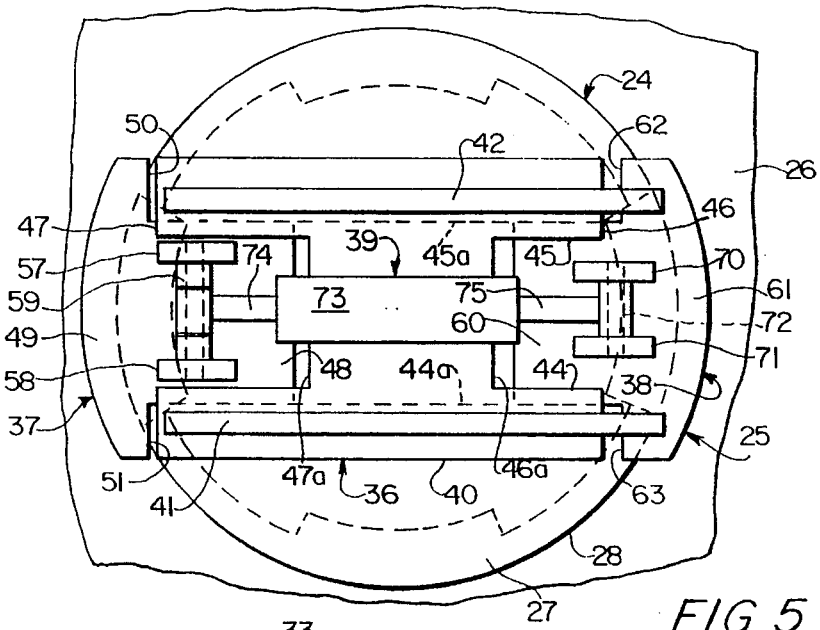
FIG. 5 is a top plan view of the coupler assembly shown in FIG. 4.
Figure 6:
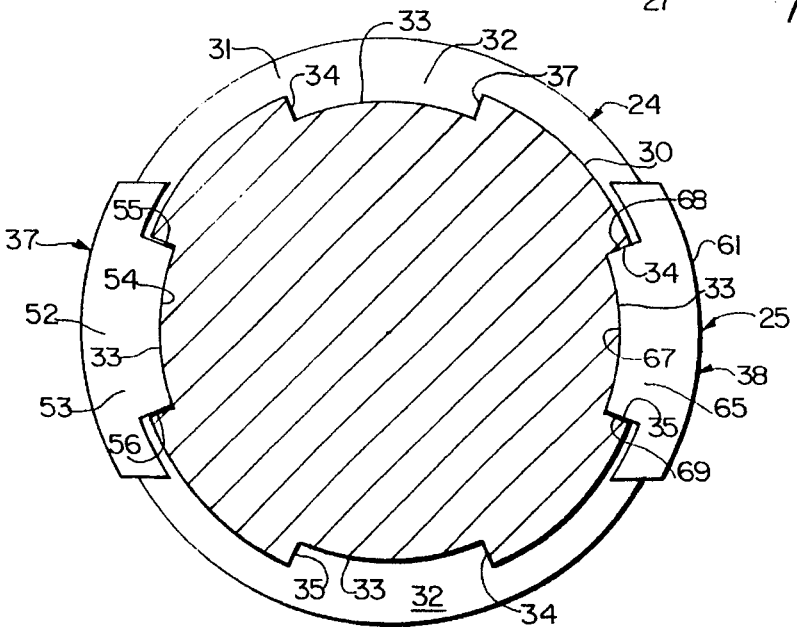
FIG. 6 is a cross-sectional view taken along line 6—6 in FIG. 4.

As best illustrated in FIGS. 4 through 6, coupling assembly 12 consists of a coupling component 24 adapted to be fixedly secured to a working implement such as a bucket 11, and a coupler component 25 adapted to be connected to the operating arm of the machine, cooperable with component 24 to selectively attach and detach the working implement to and from the operating arm. Coupler member 24 consists of a circularly configured member welded or otherwise fixedly secured to a wall portion 26 of the implement, providing a circular upper surface 27 and an annular sidewall surface 28. The annular sidewall surface is undercut as at 29 to provide an annular inner sidewall 30 and an inner, annular upper wall surface 31 spaced from implement wall 26. Inner wall surface 30 further is provided with a plurality of a circumferentially spaced recesses 32, each providing a rear arcuate wall 33 and pair of circumferentially spaced, opposed sidewall abutment surfaces 34 and 35 disposed substantially radially relative to the axis of component 24.

Referring to FIGS. 4 and 5, coupler component 25 generally includes a carrier member 36 adapted to be seated on upper surface 27 of coupling component 24, a pair of locking members 37 and 38 mounted on the carrier member, displaceable along the longitudinal centerline of the carrier member and cooperable with circumferentially spaced recesses 32 of coupler component 24 when the carrier member is seated on coupler component 24, and a hydraulic cylinder assembly 39 mounted on the carrier member along the longitudinal centerline thereof and operatively connected to locking members 37 and 38.

Carrier member 36 includes a substantially rectangularly configured base plate section 40 and pair of transversely spaced, longitudinally disposed bracket sections 41 and 42. As best shown in FIG. 4, bracket sections 41 and 42 are provided with transversely aligned openings for receiving connecting pins 22 and 43 for securing coupling member 25 to operating arm 14 and the lower end of connecting link 20. The bottom surface of base plate section 40 is provided with a longitudinally disposed slot having a pair of transversely spaced sidewalls 44 and 45 in which there is formed a pair of opposed guide slots **44*a* and 45*a* which are adapted to receive side edges of locking members 37 and 38 to guide them longitudinally. The base plate section further is recessed at its end wall surfaces 46 and 47 as at 46*a* and 47*a*** to accommodate the displacement of the locking members relative to the carrier member.

Locking members 37 and 38 are substantially similar in construction and function. As best shown in FIGS. 4 through 6, locking member 37 includes a main body section 48 having parallel side edges received in longitudinally disposed guide slots **44*a* and 45*a*, and an outer head section 49. The head section is provided with a pair of transversely aligned, inwardly facing surfaces 50 and 51 engagable with end wall surface 47 of base plate section 42 for limiting the inward displacement of the locking member, a depending portion 52 and an inwardly projecting or protruding portion 53 adapted to be received within a recess 32 of coupling component 25 when the coupling components are disposed in a coupling condition as shown in FIGS. 4 and 5**.

As best shown in FIG. 6, inwardly projecting portion 53 of locking member 37 is provided with a arcuate, inwardly facing surface 54 which is adapted an engage in arcuate surface 33, and a pair of outwardly facing side surfaces 55 and 56 adapted to confront opposed recess surfaces 34 and 35 when inwardly protruding portion 53 of locking member 37 is received within a recess 32 of coupling member 24. Main body section 48 further is provided with a pair of transversely spaced brackets 57 and 58 extending upwardly through recessed portion **47*a* of the base plate section, having a connecting pin 59** provided therein.

Locking member 38 similarly is provided with a main body section 60 having side edges received in longitudinally disposed guide slots **44*a* and 45*a* and a head section 61. Head section 61 includes a pair of transversely aligned, inwardly facing surfaces 62 and 63 adapted engage end surface 46 of base plate Section 40 to restrict the inward travel of locking member 38, a depending portion 64 and inwardly projecting or protruding portion 65. As best shown FIGS. 6, inwardly projecting or protruding portion 65 is provided with an inwardly facing, arcuate surface 67 adapted to engage an arcuate surface 33 of a recess 32, and a pair of side surfaces 68 and 69 adapted to confront a pair of spaced surfaces 34 and 35 of a recess 32 when projecting portion 65 is received within a recess 32. Locking member 38 also is provided with a pair of bracket portions 70 and 71 extending upwardly through recess 46*a* having a connecting pin 72 disposed parallel to connecting pin 59**.

Hydraulic cylinder assembly 39 is of a double-acting type and includes a fluid cylinder 73 having a pair of rods 74 and 75 connected at their outer ends to connecting pins 59 and 72. The fluid cylinder is provided with a conventional fluid supply system having operating controls located at the operator's station in the cab of the machine which may be operated in the conventional manner to supply fluid under pressure to outer and inner ports of the fluid cylinder to extend and retract locking members 37 and 38 into and out of a pair of diametrically opposed recesses 32 in coupler member 24.

Figure 2:
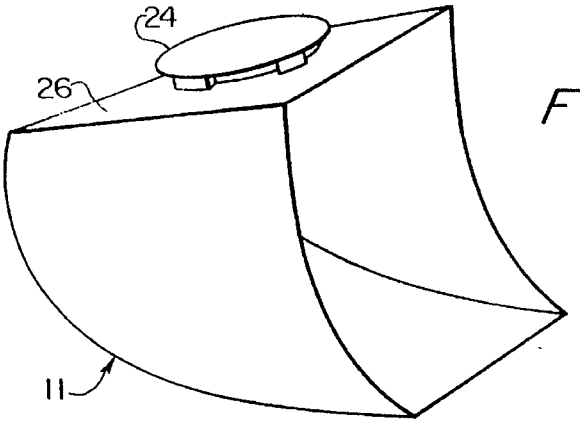
FIG. 2 is an enlarged prespective view of the implement shown in FIG. 1.
Figure 3:
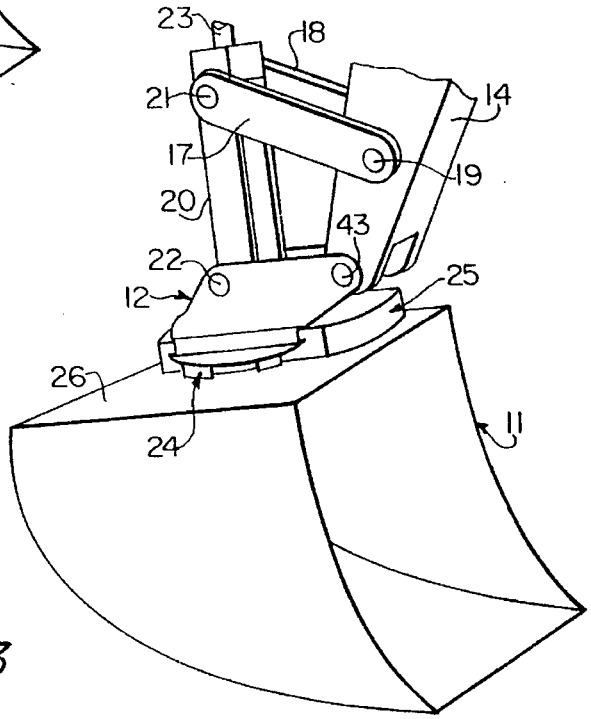
FIG. 3 is an enlarged perspective view of the implement shown FIGS. 1 and 2, illustrating the implement coupled to the operating arm of the machine by means of the assembly embodying the present invention.

In the use of the coupler assembly as described, with the bucket having coupler component 24 rigidly secured thereon, positioned on the ground as shown in FIG. 2, and coupler component 12 connected to the lower end of the operating arm as shown in FIGS. 1 and 2, the controls at the operator's station are operated to extend locking member 37 and 38 of coupling component 12, and then to position coupler component 12 in mating relation to coupler component 22, with base plate section 40 of coupler component 25 seated on coupler component 24 and disposed substantially diametrically relative to the axis thereof. The controls for the operating arm are then further operated to maneuver coupler component 25 at the desired angular position relative to coupler component 24, about the axis of component 24, so that inwardly projecting portions 53 and 65 of locking members 37 and 38 are disposed in or near alignment with a pair of diametrically opposed recesses of coupling component 24. With the locking members thus aligned or nearly aligned with a selected set of recesses 32, controls are operated to retract rod portions 74 and 75 of cylinder assembly 23 to cause inwardly projecting portions 53 and 65 of the locking members to be received in aligned recesses 32. If the locking members are a little out of alignment with a pair of recesses 32, coupler member 25 may be joggled to properly align and allow insertion of the locking members. With components 24 and 25 thus coupled together, cylinder assembly 73 may be locked in position and the implement would then be firmly connected to the operating handle to permit various work functions to be performed with the implement.

With the coupling assembly in the coupled condition as shown in FIGS. 3 through 6, angular displacement of the implement relative to the coupling component 25 and the operating arm, about the axis of the coupler component 24, is prevented by the engagement of inwardly projecting portions 53 and 65 of the locking members with confronting abutment surfaces 34 and 35 of recesses 32 of coupler component 24, and linear displacement of the coupler components along a line of travel coinciding with the axis of coupler component 24 is prevented by the engagement of inwardly projecting portions of 53 and 65 of the locking members with annular surface 31 of coupler component 24 and possibly upper wall surface 26 of the implement. Torsional forces applied to the implement, as when the implement is moved sidewise to perform a grading operation, are resisted by the engagement of abutment surfaces 34 or 35 of coupler component 24 with the locking members of coupler component 25, and not by the gripping action of the locking members to coupling component 24. Accordingly, a smaller cylinder assembly 73 may be used with the assembly as described in that a force sufficient merely to move the locking members into and out of recesses 32 is required, and not a force sufficient to firmly force the locking members into gripping relation with coupler component 24 in order to resist the torsional loads applied to the implement.

Although coupling member 24 has been described in terms of having provided therein a plurality of circumferentially spaced recesses adapted to receive the locking members of coupling component 25, it is to be understood that any configuration providing sidewalls comparable to sets of abutment surfaces 34 and 35 on coupling component 24 may be used to be engaged by the locking members for transmitting torsional loads from coupling components 24 to coupling components 25. Any gear-type configuration including a serrated configuration may be used to restrict the angular displacement of one coupling component with the other, and to transmit torsional loads. Furthermore, it will be appreciated that a greater number of recesses would provide for a greater number of angular positions of one coupling component relative to the other.

It further is contemplated that the coupling components as described may be formed of any suitable materials having sufficient strength characteristics, and by any manufacturing method, including fabricating and casting the components.

The simplicity of the coupling assembly as described and the permitted use of a smaller cylinder for securing the components in the coupled condition, not only substantially reduces the manufacturing cost of the described assembly but also reduces the mass of the assembly thereby improving the dynamics of the front end of the machine and enhancing the performance of the implement.

From the foregoing detailed description, it will be evident that there will be a number of changes, additions and modifications of the present invention which come within the provence of those persons having ordinary skill in the art to which the aforementioned invention pertains. However, it is intended that all such variations not departing from the spirit of the invention be considered as within the scope thereof as limited solely by the appended claims.

Although the embodiment as described, provides for the locking members to be displaced inwardly to be received within a pair of aligned recesses in the component rigidly secured to the implement, it also is contemplated that such locking members also may be displaced outwardly to be received within a set of recessed provided on a component secured to the implement, arranged as in an internal gear construction.

We claim:

1. An assembly for coupling an implement to an operating arm of a machine comprising:

a first coupling component fixedly mountable on said implement, having a plurality of sets of opposed abutment surfaces spaced circumferentially relative to a given axis thereof and disposed substantially radially relative to said axis, and an axially spaced abutment surface; and a second coupling component disposable in mating relation with said first coupling component, having means for detachably connecting to said operating arm, at least one locking member disposable between a first position received between a selected set of said circumferentially spaced, opposed abutment surfaces and said axially spaced abutment surface, when said components are disposed in said mating relation, and a second position clear of said abutment surfaces, and means for selectively displacing said locking member between said first and second positions.

2. An assembly according to claim 1 wherein said first coupling component is provided with an annular sidewall surface having a plurality of circumferentially spaced recesses defining said sets of opposed abutments surfaces.

3. An assembly according to claim 1 wherein said first coupling component is provided with a portion having a gear-like configuration defining said sets of opposed abutment surfaces.

4. An assembly according to claim 1 wherein said first coupling component is provided with an annular, serrated side wall surface defining said sets of opposed abutment surfaces.

5. An assembly according to claim 1 wherein said locking member is retractable radially inwardly to be received within a selected set of said opposed abutments surface and extendable radially outwardly to be withdrawn therefrom.

6. An assembly according to claim 1 wherein locking member is extendable radially outwardly to be received within a selected set of said opposed abutment surfaces and retractable radially inwardly to be withdrawn therefrom.

7. An assembly according to claim 1 wherein said first coupling component is provided with an annular sidewall having an undercut portion therein defining said axially spaced abutment surface.

8. An assembly according to claim 7 wherein said undercut portion is provided with a plurality of circumferentially spaced recesses defining said sets of opposed abutment surfaces.

9. An assembly according to claim 7 wherein said undercut portion is provided with a portion having a gear-like configuration defining said sets of opposed abutment surfaces.

10. An assembly according claim 7 wherein said undercut portion is provided with an annular, serrated wall surface defining said sets of opposed abutment surfaces.

11. An assembly according to claim 1 including a fluid actuated displacing means for displacing said at least one locking member between said first and second positions.

12. An assembly according to claim 11 wherein said displacing means comprises a hydraulic cylinder assembly.

13. An assembly according to claim 1 including a second locking member displaceable between a first position received between a selected set of said opposed abutment surfaces and said axially spaced abutment surface, and a second position clear of said abutment surfaces, simultaneously with said at least one locking member.

14. As assembly according to claim 13 wherein said locking members are displaceable along a line of travel disposed diametrically relative to said axis.

15. An assembly according to claim 14 including a fluid actuated displacing means for displacing said locking members between said first and second positions.

* * * * *